US007093471B2

(12) United States Patent
Lonero

(10) Patent No.: US 7,093,471 B2
(45) Date of Patent: Aug. 22, 2006

(54) SPLIT CAGE FOR A DEEP ROLLING MECHANISM

(76) Inventor: Vincent J. Lonero, 2838 Tiburon Dr., Bldg. 26, Unit 102, Naples, FL (US) 34109

( * ) Notice: Subject to any disclaimer, the term of this patent is extended or adjusted under 35 U.S.C. 154(b) by 103 days.

(21) Appl. No.: 10/821,519

(22) Filed: Apr. 9, 2004

(65) Prior Publication Data

US 2004/0231382 A1 Nov. 25, 2004

Related U.S. Application Data

(60) Provisional application No. 60/463,926, filed on Apr. 18, 2003, provisional application No. 60/466,590, filed on Apr. 30, 2003.

(51) Int. Cl.
*B21D 15/00* (2006.01)

(52) U.S. Cl. ..... 72/110

(58) Field of Classification Search ..... 72/107, 72/110, 237, 238, 239, 241.2, 455; 29/6.01; 384/51, 58, 621, 622, 623, 614, 560, 572, 384/578

See application file for complete search history.

(56) References Cited

U.S. PATENT DOCUMENTS

| | | | | |
|---|---|---|---|---|
| 5,699,692 | A | 12/1997 | Lonero et al. | |
| 5,806,184 | A | 9/1998 | Lonero et al. | |
| 6,159,135 | A | 12/2000 | Lonero et al. | |
| 6,253,590 | B1 | 7/2001 | Lonero et al. | |
| 6,257,037 | B1 | 7/2001 | Lonero et al. | |
| 6,360,574 | B1 * | 3/2002 | Vodopyanov | 72/110 |
| 6,601,424 | B1 * | 8/2003 | Bagusche | 72/110 |
| 6,857,785 | B1 * | 2/2005 | Takahashi et al. | 384/572 |

* cited by examiner

*Primary Examiner*—Ed Tolan
(74) *Attorney, Agent, or Firm*—Raggio & Dinnin, P.C.

(57) ABSTRACT

The present invention provides an apparatus for deep rolling an elongate workpiece such as a crankshaft or a camshaft. the apparatus includes upper and lower tools. At least one of the upper and lower tools includes a tool housing with a shaft extending therein. A roller is arranged about the shaft and rotatively supported thereon. At least one work roll rotates against the shaft, and is retained by first and second cage members secured to the housing.

16 Claims, 5 Drawing Sheets

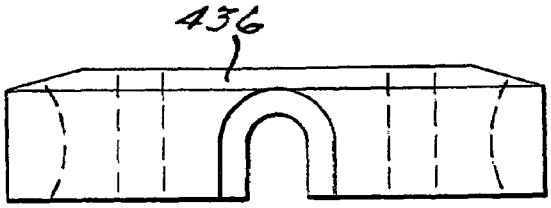
Fig. 6a.
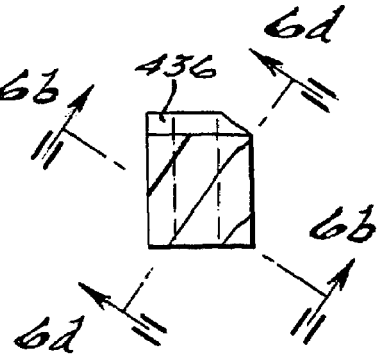
Fig. 6c.
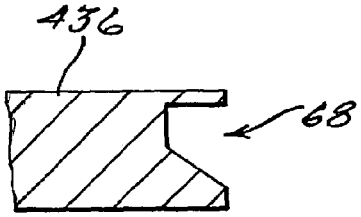
Fig. 6b.
Fig. 6d.
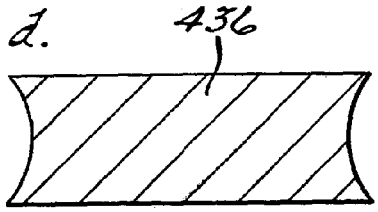
Fig. 5.
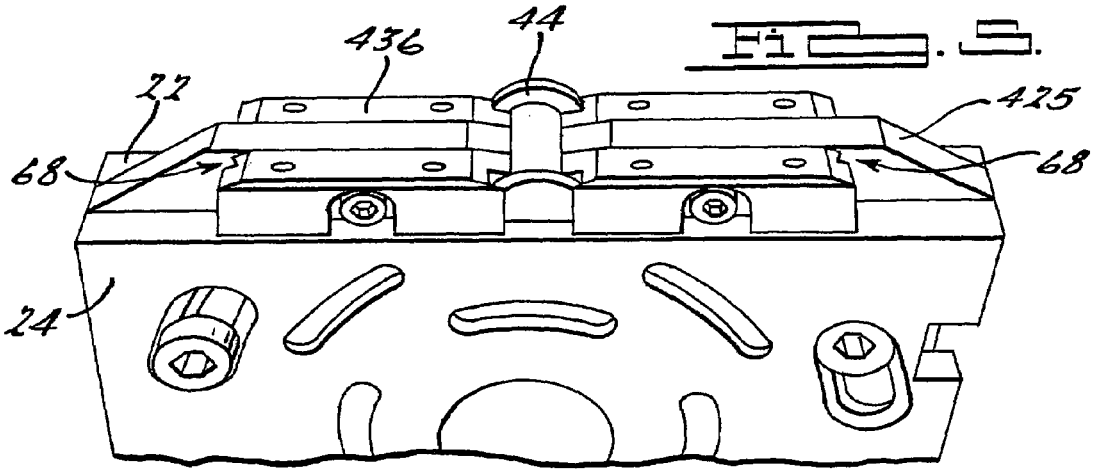

SPLIT CAGE FOR A DEEP ROLLING MECHANISM

This Application Claims the Benefit of the Filing Date of U.S. Provisional Patent Application Ser. No. 60/463,926, Filed Apr. 18, 2003, and U.S. Provisional Patent Application Ser. No. 60/466,590, Filed Apr. 30, 2003 Both of Which Are Incorporated By Reference Herein in Entirety

TECHNICAL FIELD

The invention will broadly relate to deep rolling of filets of engine crankshafts or other annular areas in metallic work pieces subject to high stress loads. More specifically, the invention will relate to a split cage for use in supporting and aligning rollers in an upper tool of a deep rolling mechanism used for deep rolling crankshafts or other similar work pieces.

BACKGROUND OF THE INVENTION

The state of the art is indicated by the following set of references. Gottschalk U.S. Pat. No. 5,495,738; Gottschalk, et al U.S. Pat. No. 5,445,003; Bone U.S. Pat. No. 5,493,761; Winkens U.S. Pat. No. 5,138,859; Betsrein U.S. Pat. No. 4,561,276; Ostertag U.S. Pat. No. 4,947,668.

It is well known in the art to have various machines and methods to strengthen and finish metal work pieces such as camshafts and crank shafts, for internal combustion engines. In many modern day automobiles engines have been downsized for installation into smaller vehicles. Accordingly, automotive vehicles and their components are being downsized to reduce weight and improve fuel efficiency, hence, smaller engines and crank shafts are needed. Therefore, there is a need to improve the fatigue strength and durability of the smaller, downsized crank shafts. This improved fatigue strength and durability is accomplished by deep rolling of fillets and other circular joint areas upon the crankshaft. The fatigue strength and durability of crank pins and main bearing journals can be significantly increased by deep rolling compressive stresses into the middle of the annular fillets between the pin journals and adjacent counter weights or balancing webs.

During the deep rolling process, the industry has known for numerous years to provide a full flooding process necessary to lubricate and/or cool the work tools and work piece while the work tools are engaging the work piece. A more recent process of lubricating and/or cooling includes a limited coolant supply in the form of a mist. Both of these cooling/lubricating methods tend to cause shavings from the work piece and other debris or foreign matter in the work area to adhere to the work piece and work tool mechanism.

The adherence of debris to the work tool and work pieces creates many problems for the industry. First, there is considerable wear and tear of the tool mechanism, effectively shortening tool life. Second, to increase the life and performance of the work tools, many man-hours are required to disassemble the work tools for cleaning and to reassemble for subsequent use of the cleaned tools. This greatly affects productivity, which is diminished because the work tools cannot be used in the deep rolling process during cleaning. Furthermore, the complexity of disassembling the work tool for cleaning and replacing any worn parts is time consuming and also affects the productivity and life expectancy of the tools. Third, debris collecting on the work area may work its way between the work tool and work piece during the deep rolling process and cause compressive stresses to be misaligned, effectively negating the purpose of the deep rolling process and negatively affecting the life of the crank shaft or other work piece being rolled. Fourth, there is the increased cost of the deep rolling process by having to replace the work rolls more often due to the negative effect of all the shavings and pieces.

There also have been problems with prior art deep rolling machines with regard to the complexity of assembling and disassembling the upper and lower tools to accommodate changes of worn out parts or cleaning of the tools themselves. The amount of time necessary to assemble and disassemble the tools, along with the down time of the line on which the tool is operating all adversely affect the productivity of the tool and the assembly line process. Furthermore, in many prior art deep rolling machines, disassembling of the tool is necessary to replace worn out roller cages, held in place by cage retainers. The roller cages in the prior art machines are set into a predetermined location with relation to the back up roller and work rolls. Once they are worn out they become ineffective and have to be replaced. This entire process is costly in the amount of time necessary to replace, as well as the cost of the parts. Therefore, there is a need in the art for adjustable roller cages that work in conjunction with cage retainers or even without the cage retainers. There also is a need in the art for adjustable split cages for use in conjunction with cage retainers or on their own within a tool structure. Also there is a need in the art for an easier to disassemble and assemble upper and lower tool, decreasing down time and maintenance, and thus increasing productivity of the deep rolling mechanism in the manufacturing environment.

SUMMARY OF THE INVENTION

One object of the present invention is to provide a design of a split cage for use in an upper or lower tool of a deep rolling mechanism.

Still another object of the present invention is to provide split cages that are adjustable while also being capable of longer life and increased productivity for the work tool.

Other objects, features and advantages of the present invention will become apparent from the subsequent description, taken in conjunction with the accompanying drawings.

According to the present invention the foregoing and other objects and advantages are obtained by a novel design for split cages for a deep rolling tool mechanism. The two-piece upper work tool 20 includes a first body member 22 and a second body member 24 which are generally mirror images of each other. The body members 22, 24 include a rectangular shaped recess 32 on one end thereof and also include a plurality of pockets or cavities on inner surfaces thereof. A plurality of split cage cages 36 are aligned and connected in the rectangular recess 32 of each body member 22, 24. These cages 36 will support the work rollers during the deep rolling of work pieces such as crankshafts and the like.

BRIEF DESCRIPTION OF THE DRAWINGS

FIG. 5 shows a partial perspective view of an upper tool according to another embodiment of the present invention.

FIGS. 6*a–d* show multiple views of a split cage according to the present invention.

FIG. 7 shows one embodiment of a split cage according to the present invention.

FIG. 8 shows another embodiment of a split cage according to the present invention.

DESCRIPTION OF THE PREFERRED EMBODIMENT AND BEST MODE FOR CARRYING OUT THE INVENTION

Many designs are known for a lower or upper work tool for use in a deep rolling machine. The present invention can be used for any known lower tool design or upper tool design. Generally, a lower work tool includes a main body essentially forming a rectangular shape that may have a V cut-out on one side thereof. It should also be noted that a generally L-shaped main body for the lower tool might also be used in another contemplated embodiment of the present invention. The main body includes a first and second member with each side symmetrically aligned relative to the other and each including a pair of spaced ridges with each edge forming an annular race. Two hubs are axially positioned between the sides and supported by oppositely aligned races with the hub secured to the ridges by flat head screws or any other known fastener. A pair of receiving rollers are rotatively supported by needle bearings with the needle bearings supported by the hubs.

Figure 1:
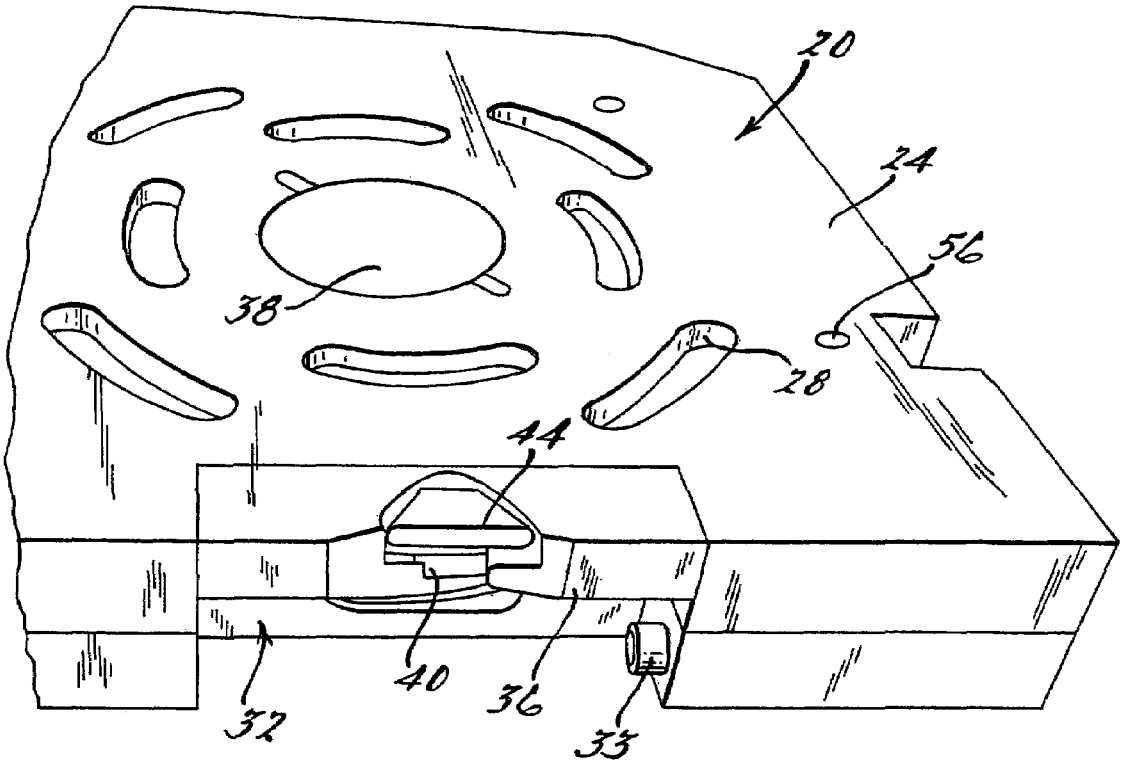
FIG. 1 shows a perspective view of an upper tool having a split cage according to the present invention.

The deep rolling machines also include an upper tool 20, 120, 220, 320 and 420, such as those shown in FIGS. 1–5. The upper tool 20 of FIG. 1 is exemplary of an upper tool in accordance with the present invention and generally includes a two-piece body or housing. Alternative embodiments having a one-piece housing are contemplated, for example tool 220 shown in FIG. 3. As used herein, like numerals identify similar or identical components of the various illustrated embodiments. The two-piece housing of tool 20 includes a first 22 and second member 24 which may be generally mirror images of each other, however, it should be noted that the two members may be completely different from each other depending upon design requirements. The two-piece housing 22, 24 generally has a square-like or rectangular-like shape. However, it should be noted that any other shape can be used depending upon the needs of the deep rolling machine. The first and second members 22, 24 of the two-piece housing also include a first and second plurality of slots 28 through a side surface thereof. These slots 28 are spaced equidistantly in a first and second radial pattern. The slots 28 are used to offer easy cleaning and lubricating of the work tool during operation. It should be noted that any other number of sets of slots or even none may also be used depending on the lubrication requirements and the design environment of the deep rolling upper tool 20.

Figure 10:
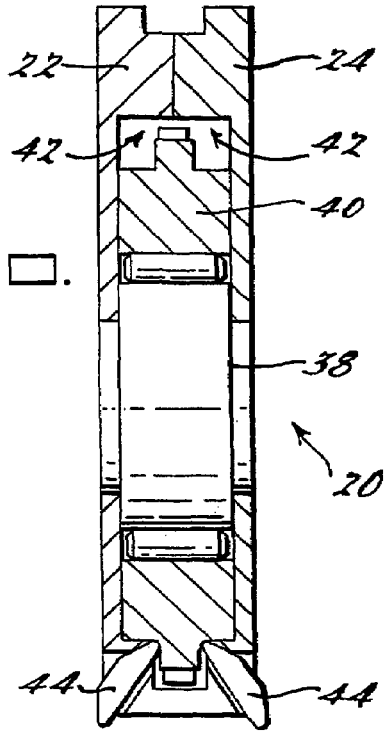
FIG. 10 shows an upper tool in cross section, similar to the tool of FIG. 1.
Figure 11A:
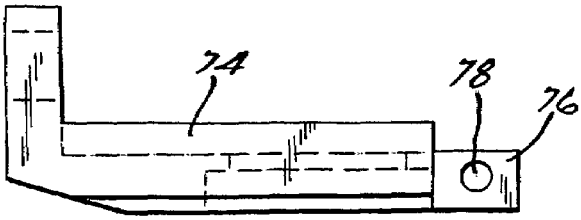
FIGS. 11*a–c* show several views of a cage retainer in accordance with the present invention.
Figure 11C:
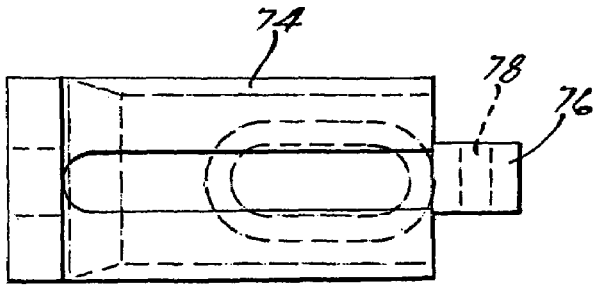
Figure 11B:
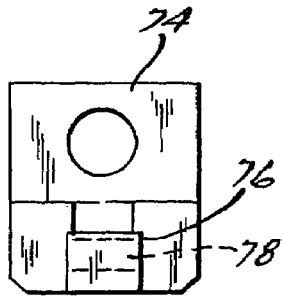

As shown in FIG. 10, a shaft 38 is arranged within the two-piece housing 22, 24 and is located within an orifice of the first and second member 22, 24 of the housing. A back-up roller 40 is arranged around the outer circumference of the shaft 38. The shaft 38 is rotatably fixed within the two-piece housing 22, 24 by a key and slot system, or by any other known means for fixing a shaft. The two-piece housing 22, 24 has a pocket 42 in each member which rotatably holds the back-up roller 40 in position while it rotates around the stationary shaft 38. The back-up roller 40 is supported by a plurality of bearings or the like around the outer circumference of the shaft 38. The back-up roller 40 will rotate at the speed developed by the work rolls 44 of the upper tool assembly. There are a plurality of work rolls 44 located at predetermined positions of the two-piece housing 22, 24. A first and second work roll 44 may be arranged within a recess 32, which is cast or machined within the two-piece housing 22, 24. It should be appreciated that reference to a "recess" herein encompass both two-piece tool designs having one recess formed in each housing member 22, 24, as well as designs having a single housing member 220, which in turn includes a single recess. It is also contemplated to have only one work roll 44 in each tool. The work rolls 44 will rotate along the surface of a crankshaft lobe or the like and also will rotate the back-up roller 40 in a reciprocal manner. It should be noted that the upper tool 20 according to the present invention is made of a steel material but that any other material such as bronze, composites, plastics, ceramics, or the like may also be used for forming the two pieces for the upper tool as described herein.

It should be noted that any combination of the split cages can be used with any existing prior art upper tool or with the present two-piece rotational design upper tool 20. The use of the split cages will allow for removal of one work roll at a time and for micro adjustments of the split cages with relation to the work roll to provide for better productivity and efficiency of the two-piece upper tool rolling mechanism.

Referring to FIG. 1, there is shown a two piece tool 20 suitable for use with a split cage design of the present invention. The split cages are mounted in a recess 32 in each half of the tool housing. Each split cage portion 36 may be formed having a bore 80 extending axially therein, as shown for example in FIG. 7. In a preferred embodiment, bore 80 receives an extension 33 or other member that protrudes into recess 32. In one embodiment, a fastener or other threaded member is used to adjust the position of extension 33, or can alternatively bear against cage member 36 directly, moving cage member 36 to various positions in recess 32. Embodiments are contemplated wherein bore 80 is internally threaded, and receives the threaded fastener in such a manner that rotation of the fastener (not shown) provides for micro-adjustment of the cage portions 36.

Figure 2:
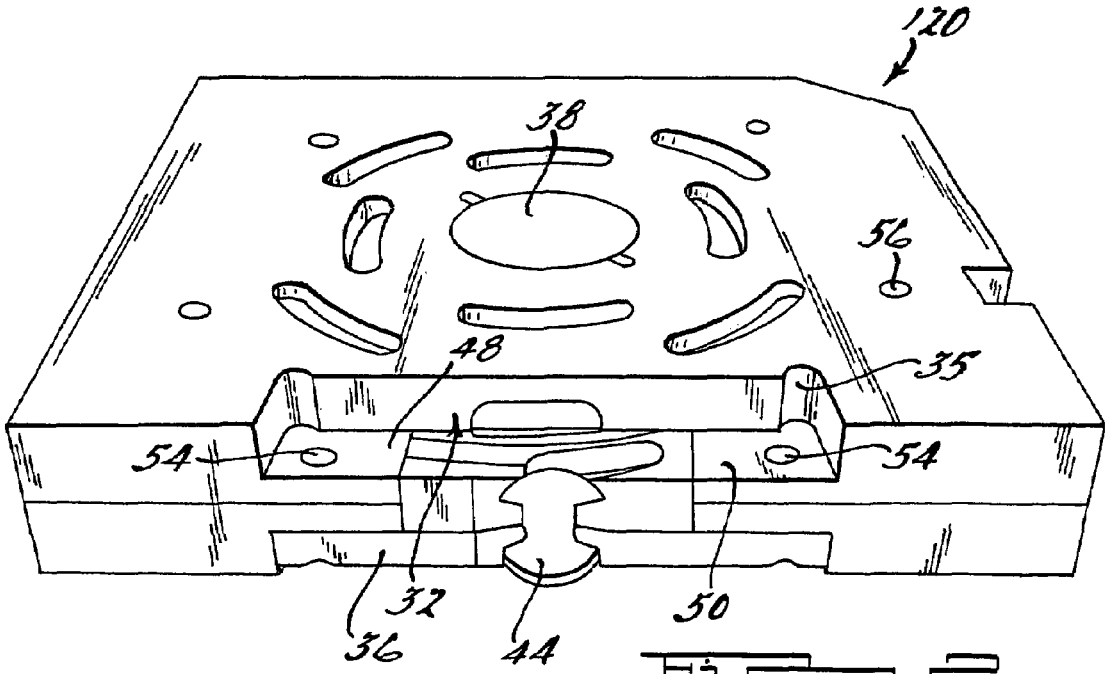
FIG. 2 shows a perspective view of an upper tool according to another embodiment of the present invention.
Figure 2:
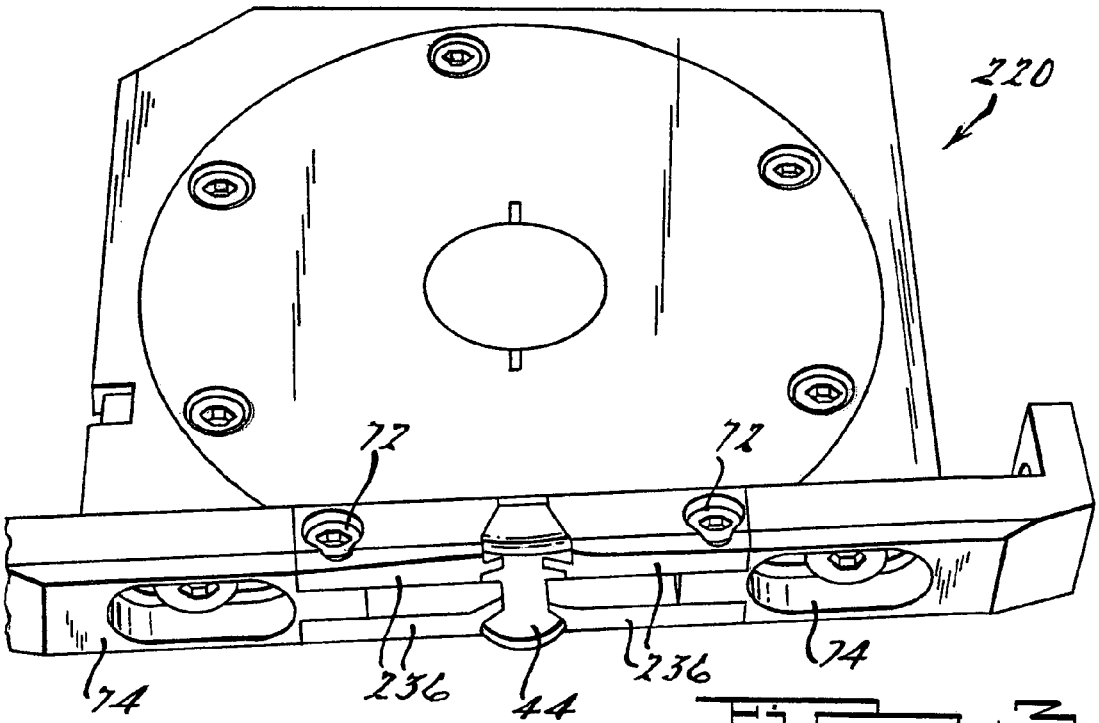
Figure 1:
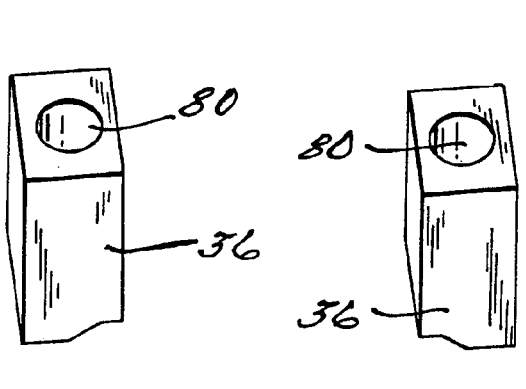

FIG. 2 shows another embodiment of the split cage 36 design. It should be noted that the split cages are designed for the above-identified split tool 20, for lower or upper tools but may also be used on existing prior art upper or lower tool housings. In this embodiment, the split cage 36 includes a rectangular shaped body 66. In one embodiment, an arcuate region of cage 36 is configured to substantially mate with an arcuate pocket region 35 in recess 32, enhancing retention of cage 36 in recess 32 in some instances. A groove or pocket 68 is formed in one end thereof, shown in FIG. 8, with the groove or pocket 68 having a shape similar to that of the work roll 44 which will be held therein. The opposite end of the split cage 36 has an orifice 70 therethrough. The orifice 70 will have a circular recess portion 72 centered over it with the circular recess portion 72 being larger in diameter to accept and hold the head of a fastener. The split cage 36 will be placed within the recess 32 of the upper tool 20 such that the orifice 70 on the split cage 36 will align with an orifice 54 on a tab 50 extending from one end of recess 32, within which cage 36 is positioned. A fastener or other securing mechanism will be used to connect and secure the split cage 36 to the tab 50 on the upper tool 20. A work roll 44 will then be placed in the pocket 68 and a second split cage 36 will be aligned in position on the tab 48 preferably directly across from but on the same plane as that of the first split cage 36. The second cage will be aligned such that the orifice 70 aligns with the orifice 54 on the second tab 48 of the upper tool 20 and secured therein. This will allow the work rolls 44 to be secured via two split cages 36 and will allow each individual work roll 44 to be replaced if worn out without having to remove an entire cage retainer or assembly, and both work rolls. Therefore, it will reduce the cost and increase the productivity of the upper and lower work tools.

FIGS. 7 and 8 show other alternate embodiments for the split cages 36 according to the present invention. FIG. 7 shows a split cage 36 generally having a rectangular shape with a pocket 68 formed in one end thereof. The opposite end of the split cage 36 includes a bore 80 therein that will accept the end of the fastener pin, dowel, etc. as explained above for use in the tool mechanism as described in FIG. 1.

Figure 9:
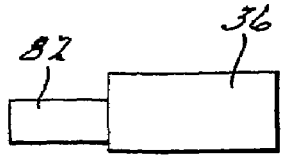
FIG. 9 shows a yet another embodiment of a split cage according to the present invention.

FIG. 9 shows another alternate embodiment for a split cage 36 generally having a rectangular shape with a pocket (not shown in FIG. 9) for receiving a work roll 44. The split cage 36 includes on the opposite end a cylindrical projection 82 extending therefrom. The cylindrical projection 82 may be placed within an orifice of the upper tool 20 in communication with recess 32 and then the dowel and fastener member within the tool housing will contact the end of the projection 82 and allow for adjustment of the split cages 36 around the work rolls 44, via movement against the projection 82. It should be noted that all three of the designs for the split cage 36 can be made from any known material such as Amoco bronze. However, any other material comparable to bronze such as steel, metals, plastics, ceramics, composites or the like may also be used.

It should be noted that the two-piece rotatable upper tool 20 increases ease of assembly and disassembly in manufacturing of the upper tool unit. It also increases productivity by lessening any cleaning time or down time due to work roll failure and wearing because of the ability to change one work roll at a time and to micro adjust the precision of the cages holding the work roll in a proper position with relation to the crank shaft being rolled by the novel split cage 36.

Figure 3:
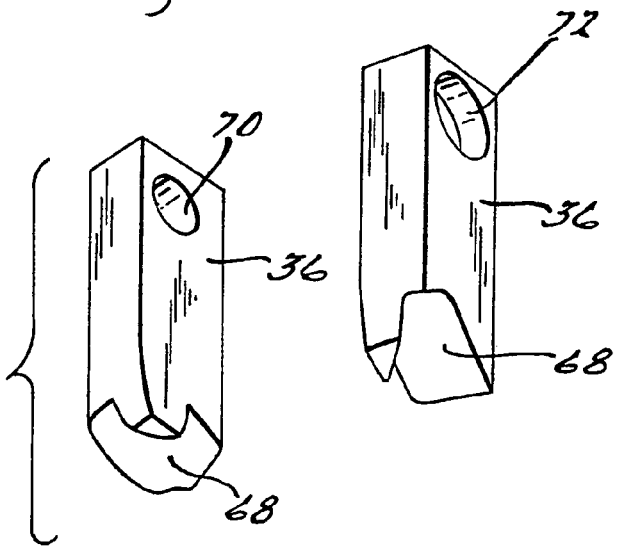
FIG. 3 shows a perspective view of an upper tool according to another embodiment of the present invention.

FIG. 3 illustrates a one piece housing 220, split cage design according to the present invention. In the FIG. 3 design, a set of cage retainers 74 are positioned adjacent the set of four cage portions 236. Cage retainers 74 are adjustable along the edge of tool 220 in a manner known in the art. Fasteners 72 are used to connect cage members 236 with cage retainers 74.

Figure 4A:
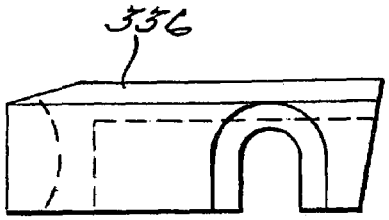
FIGS. 4*a–d* show various views of a cage retainer suitable for use with the upper tool of FIG. 4.
Figure 4B:
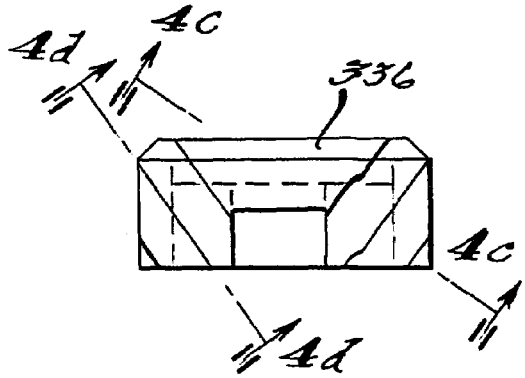
Figure 4C:
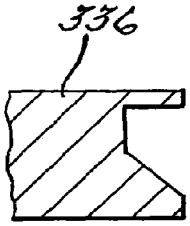
Figure 4D:
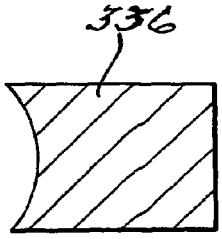
Figure 4:
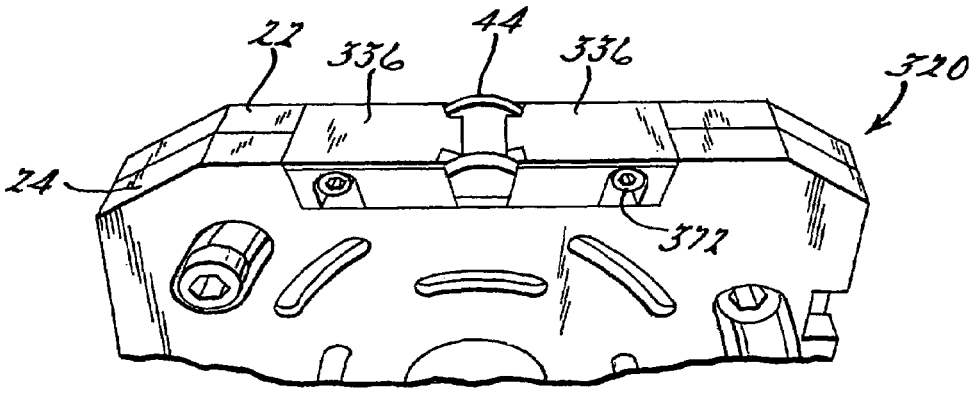
FIG. 4 shows a partial perspective view of an upper tool according to another embodiment of the present invention.

FIG. 4 illustrates a two piece housing 320 with a split cage 336 design wherein each of the cage members 336 is engaged about two work rolls 44. In this design, each cage member 336 defines a portion of two side by side pockets for retaining the work rolls 44. Fasteners 372 are used to secure the cage members 336 to tool housing members 22 and 24.

FIG. 5 illustrates yet another design for an upper tool 420 having a two piece tool housing 22, 24 and split cages 436. One or both of housing members 22, 24 includes a flange 425 extending along an edge thereof. Split cages 436 are secured to flange 425, thus it is unnecessary to form a recess in tool 420 for receipt of cages 436. It is preferred in tool 420 to provide cages 436 that are symmetrical, having pockets 68 at both ends thereof. Thus, when one pocket becomes worn, the cage members can be flipped around to position the pocket at the opposite end about the work roll.

FIGS. 6*a–d* illustrate various views of a symmetrical cage member 436 similar to the cage member shown in FIG. 5. In particular, FIG. 6*a* illustrates a front view of cage 436, FIG. 6*c* illustrates an end view of cage 436, FIG. 6*b* illustrates a first sectioned view from FIG. 6*c*, and FIG. 6*d* illustrates a second sectioned view from FIG. 6*c*. Cage member 436 includes arcuate surfaces 437 at opposite ends thereof that define a portion of a pocket positioned about the work roll 44. The split cages described herein will be used in conjunction with the appropriate two-piece upper tool system and will allow for the split cages to be reversed in some cases and adjusted to compensate for any degradation in the work rolls of the two-piece upper split tools.

While it may be apparent that the preferred embodiments of the invention disclosed are well calculated to fill benefits, objects or advantages of the invention, it will be appreciated that the invention is susceptible to modifications, variations and change without departing from the proper scope or fair and necessary use of the subjoined drawings and appended claims.

What is claimed is:

1. A tool for deep rolling an elongate work piece comprising:

a tool housing;

a shaft mounted in said housing;

a back up roller arranged about said shaft and rotatably supported thereon; and a two piece work roll cage secured to said housing and retaining at least one work roll rotatable against said back up roller, said cage is positioned in a recess formed in an end of said tool housing.

2. A tool according to claim 1 comprising two cage members in said recess, each said cage member defining a portion of a pocket for retaining a work roll.

3. A tool according to claim 2 wherein said cage members each define a portion of first and second pockets, said cage members opposed about first and second work rolls.

4. A tool for deep rolling an elongate work piece comprising:

a tool housing;

a shaft mounted in said housing;

a back up roller arranged about said shaft and rotatably supported thereon;

a two piece work roll cage secured to said housing and retaining at least one work roll rotatable against said back up roller; and said cage having four cage members, wherein each of said cage members defines a portion of a pocket for retaining a work roll, said cage members positioned in opposed pairs about two work rolls.

5. A tool according to claim 1 wherein said cage comprises two cage members, each of said cage members having an aperture for receipt of a fastener securing said cage members to said tool housing.

6. A tool for deep rolling an elongate work piece comprising:

a tool housing;

a shaft mounted in said housing;

a back up roller arranged about said shaft and rotatably supported thereon;

a two piece work roll cage secured to said housing and retaining at least one work roll rotatable against said back up roller; and each of said cage members comprises an aperture extending axially therein, said aperture adapted to receive a securing member extending from said tool housing into said recess and securing the corresponding cage member therein.

7. A tool according to claim 6 wherein each of said cage members includes an arcuate portion received in a substantially complementary region of said recess.

8. A tool for deep rolling an elongate work piece comprising:

a tool housing;

a shaft mounted in said housing;

a back up roller arranged about said shaft and rotatably supported thereon;

a two piece work roll cage secured to said housing and retaining at least one work roll rotatable against said back up roller, said cage comprises two cage members, each of said cage members having an aperture for receipt of a fastener securing said cage members to said tool housing;

said tool housing comprises first and second tabs extending from opposite ends of said recess; and said apertures are formed in lateral sides of said cage members and are adapted to receive a fastener that secures said cage members to said tabs.

9. A tool for deep rolling an elongate work piece comprising:

a tool housing;

a shaft mounted in said housing;

a back up roller arranged about said shaft and rotatably supported thereon;

a two piece work roll cage secured to said housing and retaining at least one work roll rotatable against said back up roller; and a flange extending along an edge of said tool housing, said cage comprising first and second sets of cage members positioned on opposite sides of said flange.

10. A tool according to claim 9 wherein each cage is substantially symmetrical about an aperture formed in a side thereof.

11. A deep rolling apparatus comprising:

an upper tool housing having at least one rolling member engageable with a work piece;

a lower tool housing having at least one rolling member engageable with the work piece;

at least one of said upper and lower tool housings includes a shaft mounted therein, and a back-up roller arranged about and supported on said shaft, said back-up roller rotatively supporting said at least one rolling member;

at least one of said upper and said lower tools comprises a two piece cage secured to said tool housing for retaining said at least one rolling member, said two piece cage comprises first and second cage members positioned in a recess formed in said tool housing.

12. The apparatus according to claim 11 wherein a position of said cage members in said recess is adjustable.

13. The apparatus according to claim 12 comprising a threaded fastener rotatable in said housing to adjust a position of one of said cage members.

14. The apparatus according to claim 11 wherein said two piece cage is positioned in said upper tool housing.

15. The apparatus according to claim 11 wherein said two piece cage is positioned in said lower tool housing.

16. An apparatus for deep rolling a workpiece comprising:

a tool housing;

a shaft extending in said housing;

a roller arranged about said shaft and supported thereon;

at least one work roll rotating against said shaft;

a first and second cage members defining one set, a plurality of opposed sets of cage members secured to said housing, each of said sets of cage members retaining one of said at least one work roll.

* * * * *